US007810403B2

(12) United States Patent
Cali et al.

(10) Patent No.: US 7,810,403 B2
(45) Date of Patent: Oct. 12, 2010

(54) STARTER MOTOR HAVING A PERMANENTLY ENGAGED GEAR

(75) Inventors: Connard Cali, Dublin, CA (US); Carlos Ferreira, Brusque (BR)

(73) Assignee: Conntechnical Industries, Inc., Pleasanton, CA (US)

( * ) Notice: Subject to any disclaimer, the term of this patent is extended or adjusted under 35 U.S.C. 154(b) by 259 days.

(21) Appl. No.: 11/743,717

(22) Filed: May 3, 2007

(65) Prior Publication Data

US 2007/0295162 A1 Dec. 27, 2007

Related U.S. Application Data

(60) Provisional application No. 60/746,384, filed on May 4, 2006.

(51) Int. Cl.
*F02N 15/02* (2006.01)

(52) U.S. Cl. ..... 74/7 C; 123/179.25

(58) Field of Classification Search ..... 74/7 A, 74/7 B, 7 C, 7 R, 576, 409, 440, 443, 461; 192/69.62, 84.92, 108 C, 301; 123/179.25, 123/185.1, 185.5, 185.6
See application file for complete search history.

(56) References Cited

U.S. PATENT DOCUMENTS 2,348,717 A * 5/1944 Banker ..... 192/69.83
2,691,436 A * 10/1954 Lowenstein ..... 192/84.92
3,636,792 A * 1/1972 Vigh ..... 74/461
3,880,267 A * 4/1975 Auble et al. ..... 192/108
4,884,535 A 12/1989 Iida et al.
4,955,954 A * 9/1990 Onishi et al. ..... 477/13
6,089,112 A 7/2000 Kelly et al.
6,763,735 B2 7/2004 Siems et al.
2004/0020315 A1 2/2004 Vilou et al.

FOREIGN PATENT DOCUMENTS

JP 59018262 A 1/1984

* cited by examiner

*Primary Examiner*—Richard W Ridley
*Assistant Examiner*—Terence Boes
(74) *Attorney, Agent, or Firm*—Alan Taboada; Moser IP Law Group

(57) ABSTRACT

Methods and apparatus for engaging gears in motors are provided herein. In some embodiments, an apparatus for engaging gears in a motor includes an actuator; and an engagement assembly having at least one pawl axially movably configured to selectively couple the engagement assembly with a gear via operation of the actuator. The actuator may be a solenoid, and may further be a single-coil solenoid. The apparatus may further include a shaft having the actuator and engagement assembly disposed thereon; and a gear disposed on the shaft adjacent the engagement assembly.

21 Claims, 2 Drawing Sheets

STARTER MOTOR HAVING A PERMANENTLY ENGAGED GEAR

CROSS-REFERENCE TO RELATED APPLICATIONS

This application claims the benefit of U.S. Provisional Patent Application entitled "STARTER MOTOR HAVING A PERMANENTLY ENGAGED GEAR," having Ser. No. 60/746,384, and filed May 4, 2006, which is hereby incorporated by reference.

BACKGROUND OF THE INVENTION

1. Field of the Invention

The present invention generally relates to motors, and more particularly, to gear engagement mechanisms for motors.

2. Description of the Related Art

Starter motors for internal combustion engines are designed to engage a pinion gear, a first rotatable element, with a flywheel gear, a second rotatable element. When engaged and power is applied to the starter motor, the flywheel is turned to start the engine. The conventional starter motor comprises a hold-in winding 1, a pull-in winding 2, a return spring 3, an engaging lever 4, a meshing spring 5, a driver 6, a roller-type overrunning clutch 7, a pinion 8, an armature shaft 9, a stop ring 10, a spiral spline 11, a guide ring 12, a terminal 13, a contact 14, a contact break spring 15, a moving contact 16, a solenoid switch 17, a commutator end shield 18, a brush holder 19, a carbon brush 20, a commutator 21, a pole shoe 22, an armature 23, a field frame 24, and an excitation winding 25. The arrangement and assembly of these components is well known in the art.

Conventional starter motors, for example as depicted in FIG. 1, typically require a starter assembly to be placed offset/behind the flywheel, taking up valuable envelope space in the engine. The current design further requires a heavy starter, thereby affecting vehicle's fuel economy. More importantly however, the present designs require the drive gear to advance axially forward and engage the flywheel before the starter turns. The advancement of the drive gear requires that the armature shaft be journaled on a nose casting, adding weight and complexity; requires expensive heat treat and helicoidal lamination of the armature shaft splines; requires a large solenoid to advance and hold the large mass of the drive gear; and requires a more complex offset lever system.

The large solenoid required to advance and hold the large mass of the drive gear needs extensive copper coils (2 of them) adding mass and cost. Moreover, the extensive coils require more amp draw from the electrical system, and more power wasted in order to have the starter perform its function. The large solenoid requires complex design with expensive terminals and contacts which tent to weld and wear over time. In addition, the solenoid phenolic caps tend to crack and break due to handling or thermal issues. The large solenoid design further leads to moisture accumulation and contact freezing, leading to a non-starting (click-no-crank) condition. Also, coil gassing creates deposits on the contacts, leading to electrical insulation deterioration and non-function of the starter system.

In addition, the drive gear advance results in frequent impacts with the flywheel, leading to both drive gear and flywheel damage. Accordingly, expensive heat treatments of both components are incurred to help improve component life. Moreover, the large axial travel, time, and energy expended for starting cycle to initiate and ignite engine reduces the efficiency of the operation of the starter motor and leads to premature wear and/or failure of the starter motor.

Therefore, there is a need in the art for an improved starter motor.

SUMMARY OF THE INVENTION

Methods and apparatus for engaging gears in motors are provided herein. In some embodiments, an apparatus for engaging gears in a motor includes an actuator; and an engagement assembly having at least one pawl axially movably configured to selectively couple the engagement assembly with a gear via operation of the actuator. The actuator may be a solenoid, and may further be a single-coil solenoid. The apparatus may further include a shaft having the actuator and engagement assembly disposed thereon; and a gear disposed on the shaft adjacent the engagement assembly.

In another aspect of the invention, a gear assembly is provided. In some embodiments, a gear assembly may include a shaft; a gear disposed on the shaft; an engagement assembly disposed on the shaft and having at least one pawl movably configured axially along the shaft to selectively couple the engagement assembly with the gear; and an actuator configured to selectively couple the engagement assembly to the gear.

In another aspect of the invention, a method for coupling torque to a rotatable element is provided. In some embodiments, a method for coupling torque to a rotatable element includes providing a rotatable element having at least one recess and an engagement assembly having at least one pawl; axially advancing the engagement assembly to interface with the rotatable element; and rotating the engagement assembly to engage the at least one pawl with an inner surface of the at least one recess of the rotatable element.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Figure 1:
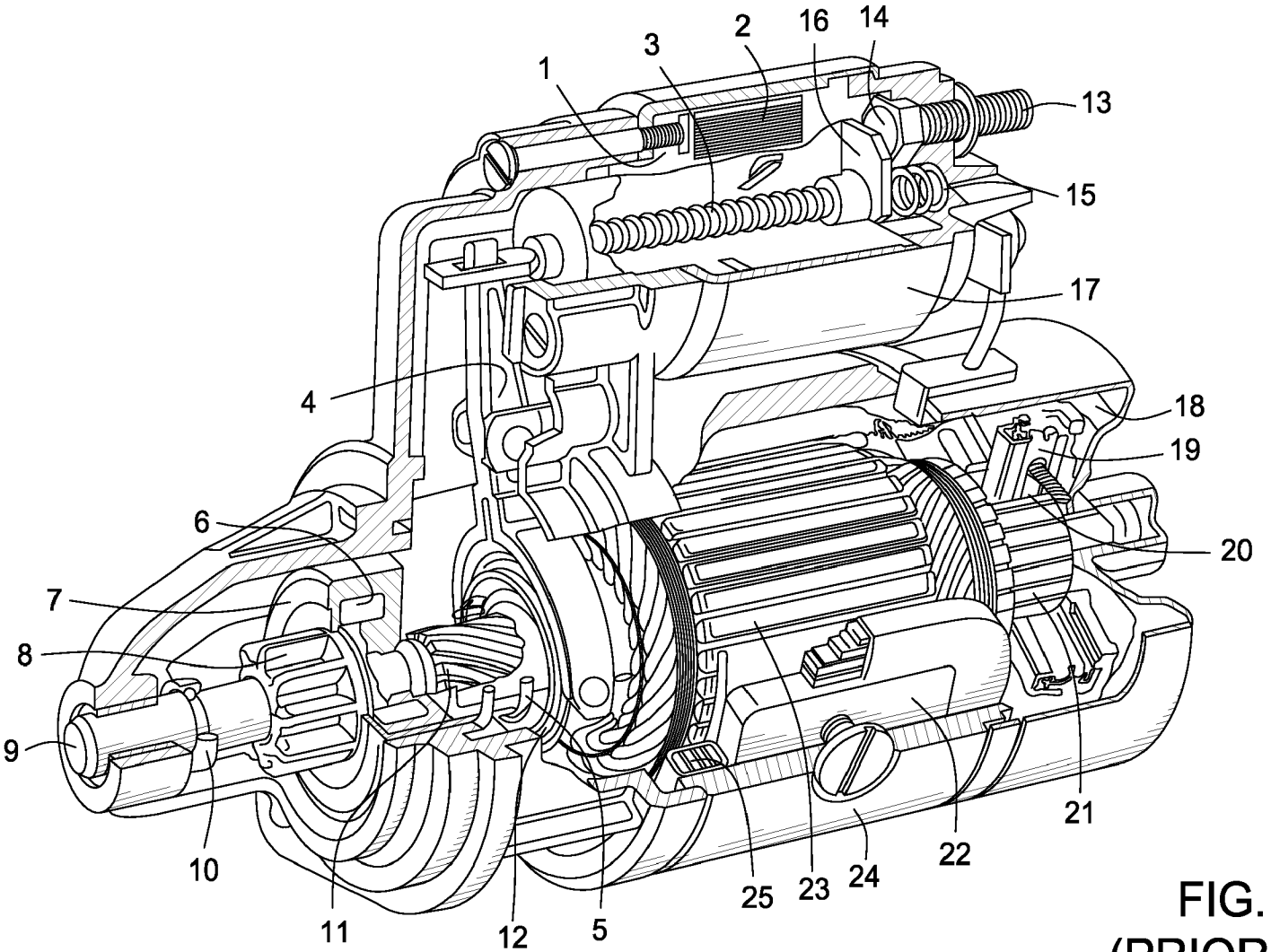
FIG. 1 (PRIOR ART)
FIG. 1 is a sectional view of a conventional starter motor.

The images in the drawings are not necessarily drawn to scale and may be simplified to enhance clarity.

DETAILED DESCRIPTION

The present invention is a method and apparatus for engaging a gear in a motor. Specifically, the present invention provides a method and apparatus for axially controlling the position of an engagement assembly with respect to a gear desired to be selectively driven.

Figure 2:
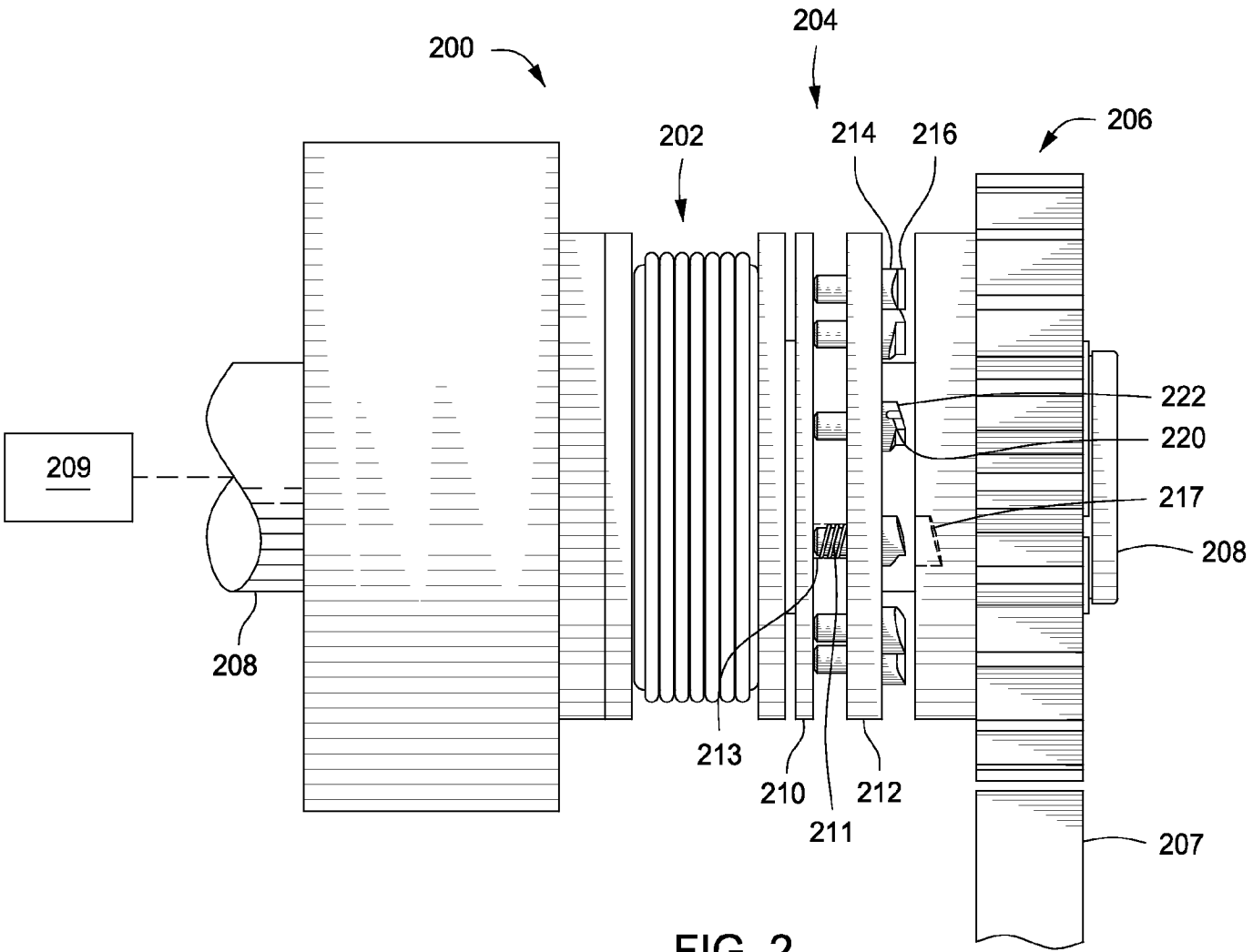
FIG. 2 is a partial side view of one embodiment of a starter motor having a permanently engaged gear.

In one non-limiting application, the method and apparatus for coupling torque may be provided within a starter motor. In the embodiment depicted in FIG. 2, a starter motor 200 is shown having an actuator (solenoid 202), engagement assembly 204, and gear (or pinion) 206 arranged on a shaft 208. A motor 209 is coupled to the shaft 208 to provide rotation thereof. The solenoid 202 is configured to be held in at least two positions corresponding to the engagement assembly 204 and the gear 206 being engaged and disengaged. Operation of the solenoid 202 controls the axial position of the engagement assembly 204 with respect to the gear 208—i.e., operation of the solenoid 202 engages or disengages the engagement assembly 204 and the gear 206. Although the gear 206 is shown in FIG. 2 as a spur gear, it is contemplated that any kind of gear or drive interface may be utilized, such as friction gears, belts and pulleys, chain and sprockets, or the like.

The engagement assembly 204 has a lower mass to be moved by the solenoid as compared to the movable gears of the prior art. For example, in some embodiments, the engagement assembly may be less than about 50% of the mass of the movable gears. In some embodiments, the engagement assembly may be less than about 20% of the mass of the movable gears. Accordingly, the lower mass engagement assembly 204 advantageously allows for a faster response and utilization of much simpler, single coil solenoids. The single coil solenoid has a low amp draw, thereby resulting in significant cost savings in materials and complexity of the solenoid. In addition, the overall number of components of the starter motor may be reduced, thereby allowing for more of the available amp power to be focused on starting the engine.

To further reduce the mass of the system, the components of the engagement assembly 204 and/or other components of the starter motor 200 (for example, the gear 208) may be fabricated, at least in part, from any robust, light-weight material, such as phenolics, engineered resins, and the like, or combinations thereof.

In one embodiment, the engagement assembly 204 comprises at least one pawl 214. The engagement assembly 204 may further comprise a drive plate 210. The drive plate 210 is axially movable on the shaft 208 and is configured to be controllably positioned along the shaft 208 via operation of the solenoid 202. The drive plate 210 contacts a bottom portion of the at least one pawl 214 and, through axial movement of the drive plate 210, controls the position of the at least one pawl along the shaft 208. Although the drive plate 210 is described herein as being part of the engagement assembly 204, it is contemplated that the drive plate 210 may be part of a solenoid assembly or otherwise separate from the engagement assembly 204. For example, the axial control mechanism, or actuator, utilized to control the operation of the engagement assembly 204 (such as the solenoid 202) may have a surface that selectively engages the pawls 214, thereby acting as the drive plate 210.

In one embodiment, the at least one pawl 214 may be movably disposed within a support ring 212 coupled to the shaft 208. In the embodiment depicted in FIG. 2, a plurality of pawls 214 are shown, disposed on the support ring 212. Each pawl 214 has a bottom portion that interfaces with the drive plate 210 and an upper portion that selectively interfaces with the gear 206. The upper portion of each pawl 214 may have a feature formed thereon, such as a flat face 216 that mates with an inner surface of a recess (shown in phantom at 217) formed in the side of the gear 206 facing the engagement assembly 204. When the engagement assembly 204, and therefore each pawl 214, is moved axially towards the gear 206, each pawl 214 enters a corresponding recess in the facing side of the gear 206 such that rotation of the shaft 208 is transmitted via the flat face 216 of the pawl 214 to the gear 206. In conventional starter motors, a drive typically travels about 0.75 inches or more to mesh with the flywheel. In some embodiments of the present invention, the pawls 214 may travel 0.25 inches or less to engage the gear 206, thereby facilitating a smaller footprint for the starter motor 200.

Optionally, each pawl 214 may further include an a slot 220. The slot 220 may optionally be filled with a damping material 222 capable of absorbing shock when the pawl 214 engages with the gear 206. Non-limiting examples of suitable materials for the damping material 222 may include, polymers, such as polydimethacrylates (PDMA), polyisoprene or natural rubber, polybutadiene, polyisobutylene, polyurethanes, and the like) Each slot 220 is oriented across the width of the pawl 214 to divide the upper region of the pawl 214 into a first portion and second portion. The slot 220 may further be radially aligned with a central axis of the shaft 208. The slot 220 enables the second portion of the pawl 214 to flex and bend towards the first portion upon impact of the flat face 216 of the pawl 214 with the recess formed in the gear 206. The damping material 222, when present, facilitates absorption of the initial shock of this impact. The flexibility mitigates the shock that may be transferred during initial engagement to other components of the system, such as the starter motor, the shaft, or other components coupled thereto.

Each pawl 214 may be biased towards a retracted position (e.g., away from the gear 206), such as by springs 211, resilient materials, and the like (generally illustrated by dotted box 213). Alternatively, the at least one pawl 214 may be coupled to the drive plate 210 or the actuator (for example, the solenoid 202) such that retraction of the drive plate 210 or the solenoid 202 directly retracts the at least one pawl 214 from the gear 206.

Although described above as utilizing a solenoid, it is contemplated that other actuators or control mechanisms may be utilized to control the axial position of the engagement assembly 204 of the starter motor 200 as well. In one example, the shaft 208 may be helically splined with an aggressive pitch thread and a large mass may be placed on the shaft 208. Once the starter is electrically activated, the armature spins up quickly, and the large mass moves up the spline, thereby advancing towards the drive plate 210 and pawls 214, and moving the pawls 214 into engagement. The large mass may be retained in the advanced axial position until the starter's rpm is decreased below a certain value by methods known to those skilled in the art.

Although the gear 208 is described above as a spur gear for interfacing and engaging with a flywheel, it is contemplated that other engagement interfaces may suitably be utilized as well. For example, the gear 208 may have a knurled or smooth cylindrical rubber (or other suitable material) surface for interfacing with a rubberized flywheel. In some embodiments, a belt (such as comprising rubber or other suitable material) may connect the gear 208 (or rubberized cylinder, grooved pulley, or the like) to the flywheel. In some embodiments, the rpm of the system may be controlled via a gear set in mesh with the flywheel. For example, a starter motor as described above may interface with the gear set instead of directly with the flywheel in order to maintain the starter motor and or the flywheel within a desired rpm range.

Numerous benefits are obtained through the improved starter motor assembly. Specifically, the starter motor can be butted up against the flywheel and directly mounted off engine, thereby reducing the footprint required for the starter motor in the engine bay. The starter motor is lighter, has fewer components, and therefore utilizes a much simpler single coil solenoid, having a low amp draw, thereby resulting in significant cost savings in materials and complexity of the solenoid. In addition, the overall number of components of the starter motor can be reduced, allowing for more of the available amp power to be focused on starting the engine, and not wasted/consumed by the starter's own needs due to larger components.

Moreover, the permanently engaged drive pinion (e.g., gear 206) with flywheel (e.g., a second gear 207) eliminates the need for axial movement of the pinion, thereby eliminating meshing interactions between the pinion gear and the flywheel, eliminating damage due to impact of the pinion and the flywheel, and preventing damage due to partial engagements of the pinion and the flywheel.

In small engine applications (such as, outboards, lawn & garden, and the like), the improved starter motor design eliminates the engine's propensity to spit the drive out of engagement with the flywheel due to high rpm variations of the rough piston firing sequence. Specifically, the starter motor design keeps the drive gear in permanent mesh, so it cannot be spit out of flywheel engagement.

Another advantage of the present invention is that the solenoid axial travel is minimal, leading to fast starter response, including applications for hybrid systems. Moreover, the present starter motor system reduces wear of drive components since the pawls recede after the engine ignites.

The inventive system described herein can also be applied to any non-automotive combustion engine application; hybrid vehicles; industrial conveyor systems that require fractional advance/engagement of a drive motor; and potential applications into vehicle transmissions where controlled pawl advances can engage specific gear ratios.

While the foregoing is directed to embodiments of the present invention, other and further embodiments of the invention may be devised without departing from the basic scope thereof, and the scope thereof is to be determined by the following claims.

The invention claimed is:

1. A starter motor assembly, comprising:

a shaft;

a gear disposed on the shaft, wherein the gear is axially fixed with respect to the shaft and rotatable with respect to the shaft;

an engagement assembly disposed on the shaft and rotationally fixed with respect to the shaft, the engagement assembly having at least one pawl to move axially with respect to the shaft to selectively couple the engagement assembly with the gear;

an actuator disposed on the shaft to selectively couple the engagement assembly to the gear; and the starter motor coupled to the shaft to provide rotation thereof.

2. The assembly of claim 1, wherein the actuator comprises a solenoid.

3. The assembly of claim 1, wherein the gear further comprises a corresponding number of recesses configured to interface with the at least one pawl of the engagement assembly.

4. The assembly of claim 1, wherein the engagement assembly has a lower mass than the gear.

5. The assembly of claim 1, wherein the face of at least one of the at least one pawls further comprises:

a feature configured to mate with a corresponding feature formed in the gear.

6. The assembly of claim 1, wherein the engagement assembly is at least partially fabricated from a phenolic or an engineered resin.

7. The assembly of claim 1, wherein the actuator is a single coil solenoid.

8. The assembly of claim 1, further comprising:

a second gear fixedly meshed with the gear.

9. The assembly of claim 8, wherein the second gear is a flywheel.

10. The assembly of claim 8, wherein, the gear and the second gear are axially fixed with respect to each other.

11. The assembly of claim 1, wherein the gear is rotationally fixed with respect to the engagement assembly when the gear is engaged by the least one pawl of the engagement assembly.

12. The assembly of claim 1, wherein the at least one pawl further comprises:

a slot formed through an upper region of the at least one pawl to define a first portion of the at least one pawl that selectively interfaces with a corresponding surface of the gear when the at least one pawl engages the gear and a second portion of the at least one pawl that does not interface with the gear, wherein the first portion is capable of flexing upon impact of the first portion with the corresponding surface of the gear.

13. The assembly of claim 12, further comprising:

a damping material filling the slot in the pawl.

14. The assembly of claim 1, wherein the engagement assembly further comprises:

a support ring having the at least one pawl movably disposed therein.

15. The assembly of claim 14, further comprising:

a drive plate movably disposed adjacent the support ring, wherein the drive plate controls a position of each pawl.

16. The assembly of claim 15, wherein each pawl is coupled to the drive plate.

17. The apparatus assembly of claim 15, wherein each pawl is biased towards a retracted position within the support ring by a resilient material.

18. The assembly of claim 1, wherein the at least one pawl comprises a plurality of pawls.

19. The assembly of claim 10, wherein the gear further comprises a corresponding plurality of recesses configured to selectively interface with the plurality of pawls.

20. The assembly of claim 1, wherein the gear is at least partially fabricated from a phenolic or an engineered resin.

21. The assembly of claim 1, wherein the pawls have a range of axial motion with respect to the shaft of 0.25 inches or less between a retracted position and an extended position to engage the gear.

* * * * *